US008307526B2

(12) United States Patent
Jang

(10) Patent No.: US 8,307,526 B2
(45) Date of Patent: Nov. 13, 2012

(54) HEMMING DEVICE FOR WHEEL HOUSING OF VEHICLE

(75) Inventor: Yoon Jang, Incheon (KR)

(73) Assignees: Hyundai Motor Company, Seoul (KR); Kia Motor Corporation, Seoul (KR)

( * ) Notice: Subject to any disclaimer, the term of this patent is extended or adjusted under 35 U.S.C. 154(b) by 264 days.

(21) Appl. No.: 12/859,980

(22) Filed: Aug. 20, 2010

(65) Prior Publication Data

US 2011/0131778 A1 Jun. 9, 2011

(30) Foreign Application Priority Data

Dec. 3, 2009 (KR) ..... 10-2009-0119426

(51) Int. Cl.
*B21D 39/02* (2006.01)

(52) U.S. Cl. ..... 29/243.58; 72/306

(58) Field of Classification Search ..... 29/243.5, 29/243.58; 72/101, 112, 211, 214–216, 237, 72/306

See application file for complete search history.

(56) References Cited

U.S. PATENT DOCUMENTS

| | | | | |
|---|---|---|---|---|
| 4,472,867 | A * | 9/1984 | Wivinis | 29/243.5 |
| 7,500,373 | B2 * | 3/2009 | Quell | 72/214 |
| 7,950,260 | B2 * | 5/2011 | Kinouchi et al. | 72/220 |
| 2008/0307630 | A1 * | 12/2008 | Hasegawa et al. | 29/509 |
| 2010/0154503 | A1 * | 6/2010 | Hasegawa et al. | 72/199 |
| 2010/0252973 | A1 * | 10/2010 | Reith et al. | 269/37 |

FOREIGN PATENT DOCUMENTS

| | | | |
|---|---|---|---|
| JP | 2007-152395 | A | 6/2007 |
| KR | 10-0872601 | B1 | 12/2008 |

* cited by examiner

*Primary Examiner* — David B Thomas
(74) *Attorney, Agent, or Firm* — Edwards Wildman Palmer LLP; Peter F. Corless

(57) ABSTRACT

The present invention provides a hemming device for a wheel housing of a vehicle where a hemming bed unit is attached to an installation frame at one side of the wheel housing, and where a worker can manually hem an inner panel and an outer panel by rotating a hemming roller unit for each process of which the lower portion is fixed to the upper center of the installation frame by a rotary clamper.

15 Claims, 9 Drawing Sheets

HEMMING DEVICE FOR WHEEL HOUSING OF VEHICLE

CROSS-REFERENCE TO RELATED APPLICATION

This application claims priority to and the benefit of Korean Patent Application No. 10-2009-0119426 filed in the Korean Intellectual Property Office on Dec. 3, 2009, the entire contents of which are incorporated herein by reference.

BACKGROUND OF THE INVENTION (a) Field of the Invention

The present invention relates to a hemming device for a wheel house of a vehicle. More particularly, the present invention relates to a hemming device for a wheel house of a vehicle which is attached to one side of the wheel house of the vehicle body and allows a worker to manually hem an inner panel and an outer panel.

(b) Description of the Related Art

When manufacturing a vehicle. automobile manufactures assemble twenty to thirty thousand of parts many times.

The manufacturing of a vehicle body is the first step of the manufacturing process of a vehicle. Typically, a white body (B.I.W) vehicle body is manufactured by producing product panels with various presses, delivering them to a vehicle body factory, and then assembling the parts of the product panels.

In order to form such panels, a forming process for press forming the panels into a predetermined shape with various presses is used, and then cutting, hole forming, curving, and bending are performed in press processes, such as trimming, piercing, flanging, and hemming.

Hemming is increasingly used for the rear wheel housing of a vehicle body such as by a curl hemming engineering method, in order to ensure a tolerance between the tire and the vehicle body panel and to improve rust-proof performance by preventing rust at the joints, for mounting a low profile tire, as shown in FIG. 1.

For example, when assembling an inner panel 103 and an outer panel 1010 using the curl hemming engineering method the inner panel 103 is appropriately arranged with respect to an outer panel 101 (S1). A hemming bed 105 is seated on the outer surface of the outer panel 101 (S2) and a first bending (45°) is performed, using a roller 107 moved by a robot (S3).

Thereafter a second bending (90°) (S4) is performed. The curl hemming process is completed by performing a main hemming (S5) after the second bending (S4) is finished.

The robot roller hemming engineering method that is currently used for the rear wheel housing of vehicle bodies takes a long time to be normalized, when the line stops due to reasons, such as when the robot breaks down, fatigue failure, friction, and problems with the parts of the roller hemming, damage to the system due to wrong operation of a line stop worker, and wrong correction of an electric program of the hemming. Consequently, productivity decreases which also leads to economical loss.

Therefore, it is desirable to develop a hemming device for a wheel housing of a vehicle that has high operability against line stop where a worker can perform such hemming with excellent quality and makes it possible to ensure manual hemming quality.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention features a hemming device for a wheel housing of a vehicle. Such a hemming device is advantageously configured so as to allow a worker to manually hem an inner panel and an outer panel. Such a device includes a hemming roller unit, a lower portion of which is fixed to the upper center of the installation frame by a rotary clamper. Further a hemming bed unit is attached to the frame at one side of the wheel housing of the vehicle body. By rotating the hemming roller unit for each process a worker can hem the panels making up the wheel housing.

In further aspects/embodiments of the present invention, there is provided a hemming device for a wheel house of a vehicle that performs hemming to an outer panel with respect to an inner panel of the wheel house while supporting the outer surface of the outer panel of the wheel house of a vehicle body. Such a hemming device includes: an installation frame that is formed by support beams supported by dampers at both sides on an installation plate with casters thereunder and an installation beam disposed at the center on the installation plate; and a hemming bed unit, where the hemming bed is fixed to the upper ends of the support beams on the installation frame. The wheel house is supported by attaching the hemming bed to the outer surface of the outer panel of the wheel house of the vehicle body. Also included are body; bed fixing members disposed at both sides of the installation beam of the installation frame, where the hemming bed is fixed to the outer panel of the wheel house; and a hemming roller unit mounted to the upper end of the installation beam of the installation frame by a rotary clamper and hemming the outer panel with respect to the inner panel of the wheel house by manually rotating two hemming rollers.

In further embodiments, the hemming bed unit includes: a hemming bed formed in an arc shape along the wheel housing and having both ends fixed to the upper ends of the support beam of the installation frame; a reference pin provided at one end of the hemming bed and fitted in a reference hole formed at one side of the wheel housing, restraining pads provided at the other end adjacent to the other side of the hemming bed and restraining one side of the side panel of the vehicle body in the up-down direction; and a latch clamper provided at one side of the center of the hemming bed and clamping the other side of the side panel of the vehicle body.

In further embodiments, the restraining pads provided at the other side of the hemming bed, are installed by a restraining bracket fixed to the hemming bed.

In further embodiments, the latch clamper is provided on an extender that extends outside from one side of the center of the hemming bed.

In yet further embodiments, the bed fixing member is a latch clamper that is installed corresponding to both ends on the hemming bed, on the other end of the fixing beam of which one end is fixed to both sides of the installation beam of the installation frame.

In further embodiments, the hemming roller unit includes: a lower rotary beam having a rotational hole at the lower portion that is fastened to the installation beam by a rotary shaft bolt with the rotary clamper, and a pitch adjusting slot formed at one side; an upper rotary beam fitted on the lower rotary beam and provided with an adjusting bolt fitted in the pitch adjusting slot of the lower rotary beam and a hinge end formed at the upper end; a spring inserted in the upper rotary beam, with both ends fixed to the inner upper surface of the upper rotary beam and the upper end of the lower rotary beam; roller support links hinged to hinge ends of the upper rotary beam; hemming rollers rotatably installed in the upper ends of the roller support links; and a gap adjusting bolt disposed between the roller support links and adjusting the gap between the hemming rollers.

In further embodiments, a rotary handle is provided to a handle beam at one side of the upper rotary beam.

In further embodiments, the hemming rollers are hemming rollers for first bending, which are arranged so that there is an angle of 45° between the rollers.

In yet further embodiments, the hemming rollers are hemming rollers for second bending, which are arranged so that there is an angle of 0° between the rollers.

In yet further embodiments, the hemming rollers are curl hemming rollers, which are arranged so that there is an angle of 0° between the rollers.

Such a hemming device of the present invention in which a hemming bed unit is attached to an installation frame at one side of the wheel housing of the vehicle body, allows a worker to manually hem an inner panel and an outer panel by rotating a hemming roller unit for each process of which the lower portion is fixed to the upper center of an installation frame by a rotary clamper.

That is, the hemming device for a wheel housing of a vehicle allows a worker to manually hem the wheel housing in the process of the vehicle body side line, such that hemming can be performed by the worker, with excellent quality, even when the automatic line is stopped by breakdown of the line. As a result, the hemming device of the present invention improves operability against a line stop.

Other aspects and embodiments of the present invention are described herein.

BRIEF DESCRIPTION OF THE DRAWINGS

For a fuller understanding of the nature and desired objects of the present invention, reference is made to the following detailed description taken in conjunction with the accompanying drawing figures wherein like reference characters denote corresponding parts throughout the several views and wherein.

DETAILED DESCRIPTION OF THE EMBODIMENTS

As described further herein, the present invention features a hemming device for a wheel housing of a vehicle that performs hemming to an outer panel with respect to an inner panel of the wheel house while supporting the outer surface of the outer panel of the wheel house of a vehicle body. Such a hemming device includes an installation frame, a hemming bed, bed fixing members and a hemming roller unit.

The hemming bed unit fixes the hemming bed to an upper portion of the installation frame and supports the wheel housing by attaching the hemming bed to the outer surface of the outer panel of the wheel housing. The bed fixing members are disposed at both sides of a segment of the installation frame and fix the hemming bed to the outer panel of the wheel house. The hemming roller unit is mounted to an upper end of the installation frame upper portion by a rotary clamper and hems the outer panel with respect to the inner panel of the wheel house by manually rotating two hemming rollers.

In further embodiments, the installation frame is formed by support beams supported by dampers at both sides on an installation plate with casters thereunder and an installation beam disposed at the center on the installation plate. The hemming bed unit fixes the hemming bed to the installation frame and supports the wheel housing by attaching the hemming bed to the outer surface of the wheel housing outer panel.

In yet further embodiments, the installation frame includes an installation beam; and the bed fixing members are disposed at both sides of the installation beam fixing the hemming bed to the outer panel of the wheel house.

In yet further embodiments, the installation frame includes an installation beam; and the hemming roller unit mounted to an upper end of the installation beam by a rotary clamper and hemming the outer panel with respect to the inner panel of the wheel house by manually rotating two hemming rollers.

Figure 1:
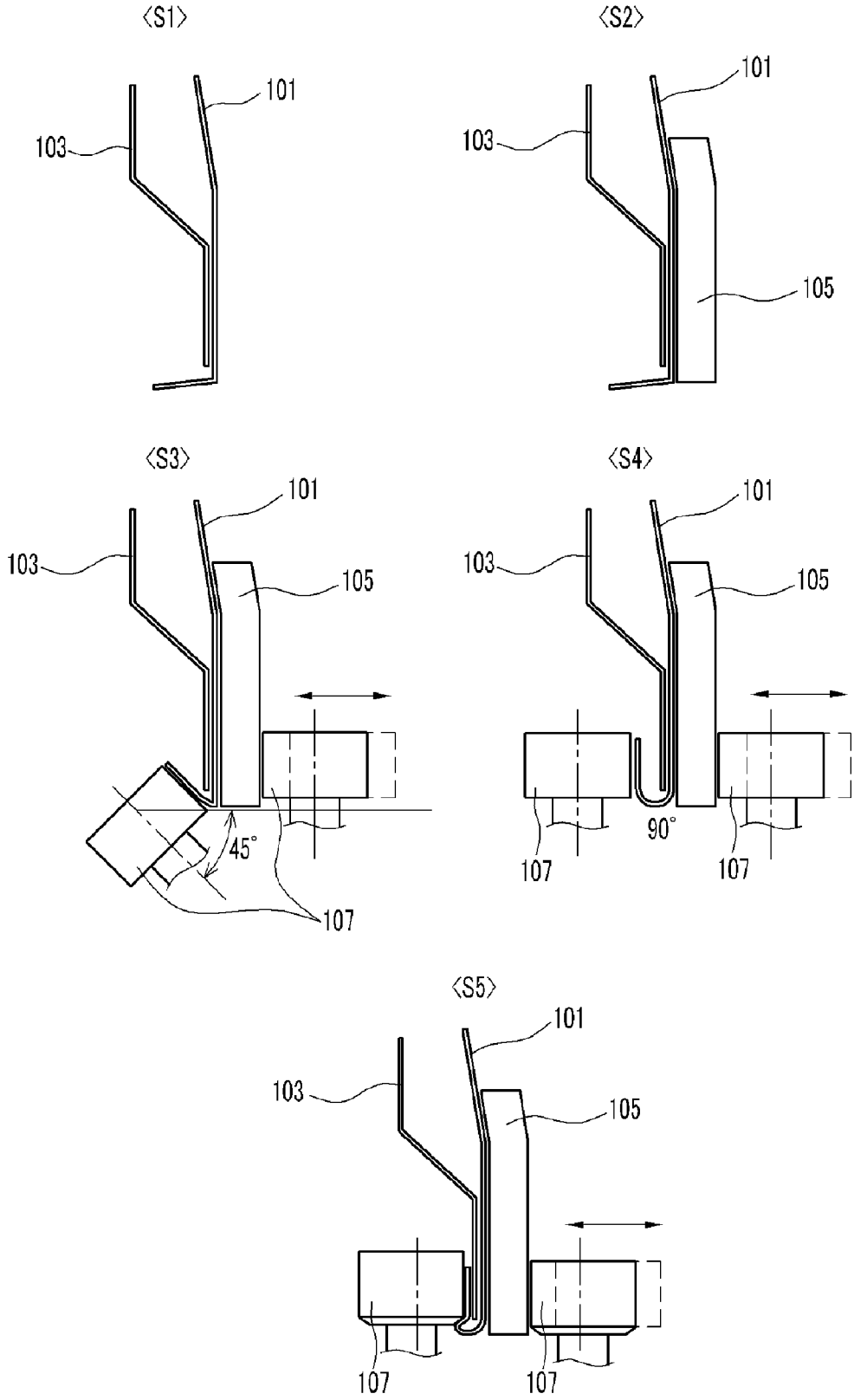
FIG. 1 includes illustrative views showing a conventional curl hemming process using a conventional roller hemming device.
Figure 2:
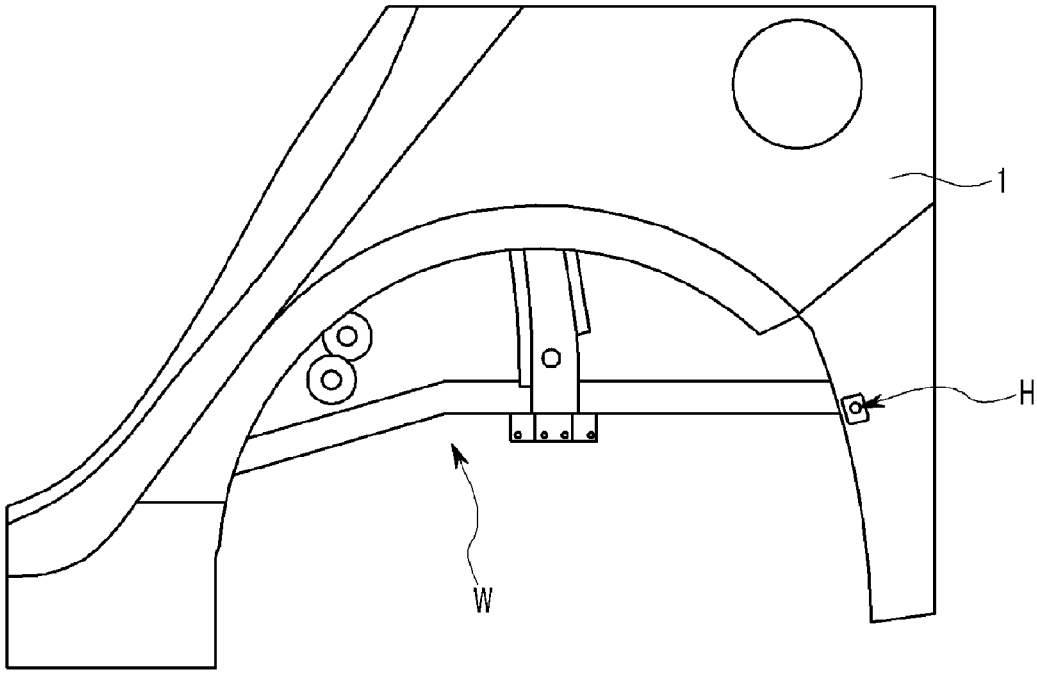
FIG. 2 is a side view of a wheel house showing a hemming device according to the present invention being applied thereto.
Figure 3:
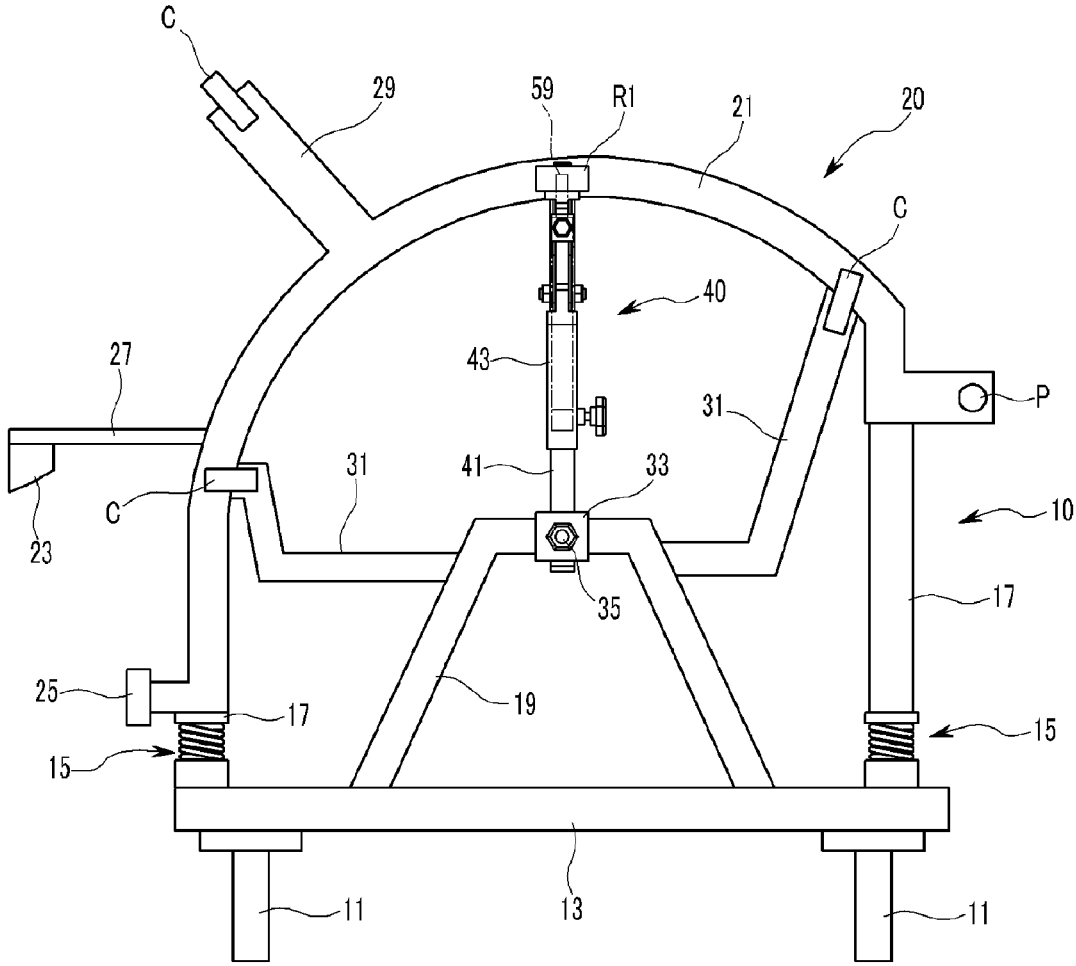
FIG. 3 is a front view of a hemming device of the present invention.

Referring now to FIGS. 2-6, there is shown in FIG. 2 a side view of a wheel housing where a hemming device according to the present invention being applied thereto is applied and there is shown in FIG. 3 a front view of a hemming device of the present invention.

Figure 4:
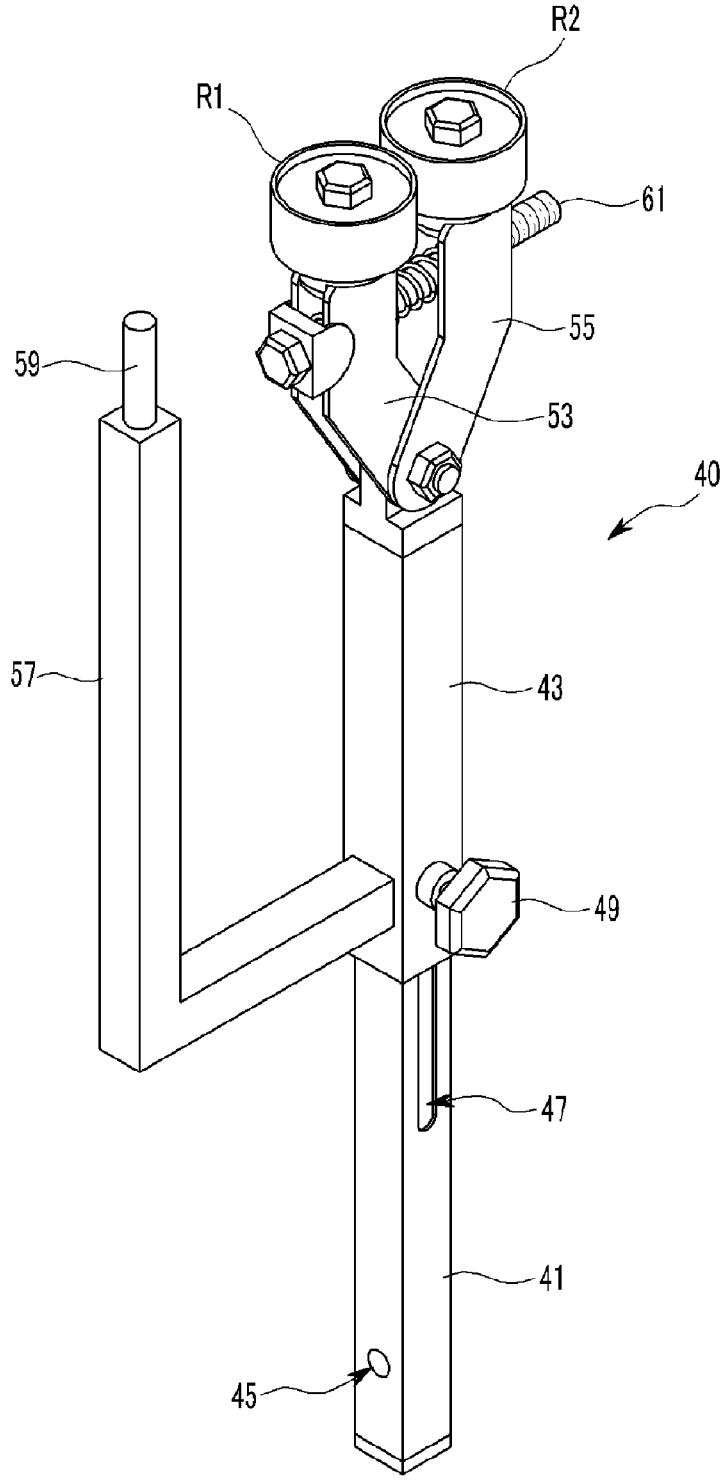
FIG. 4 is a perspective view of a hemming roller unit that is applied to a hemming device of the present invention.
Figure 5:
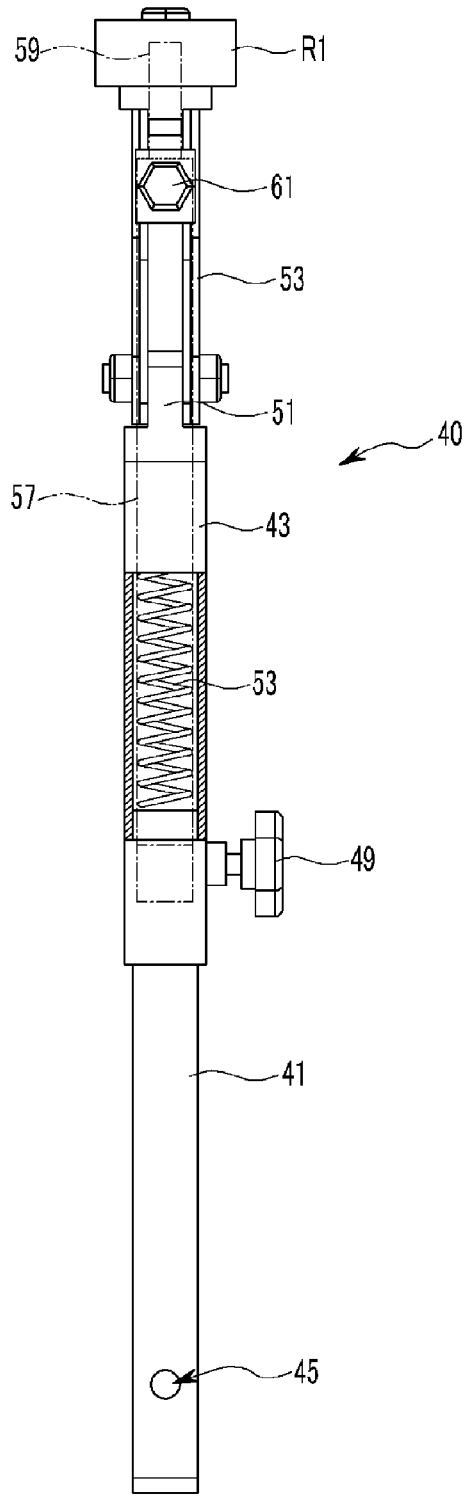
FIG. 5 is a partial front cross-sectional view of a hemming roller unit of the present invention.
Figure 6:
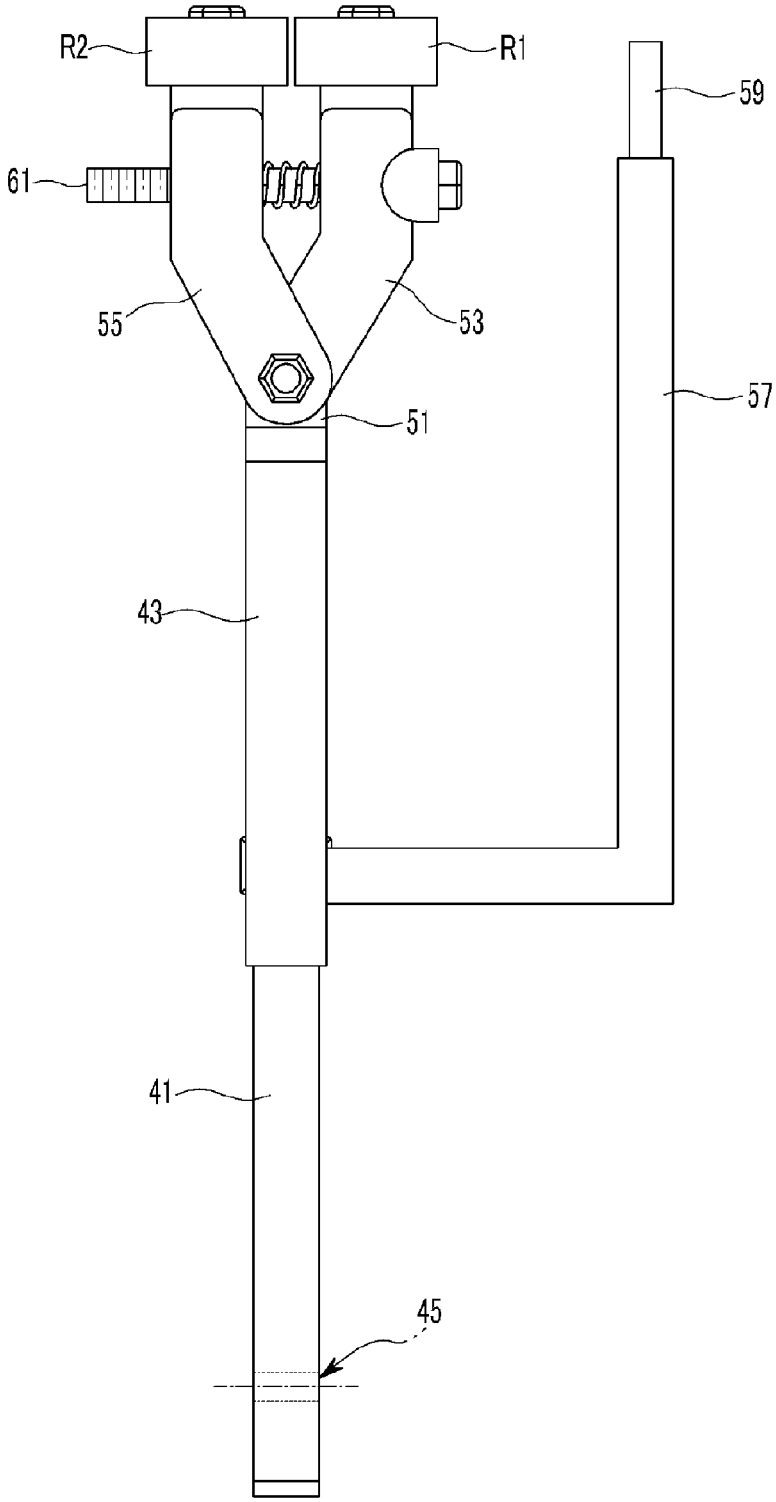
FIG. 6 is a side view of a hemming roller unit of the present invention.

As to FIGS. 4-5, there is shown a perspective view of a hemming roller unit that is applied to a hemming device (FIG. 4), a partial front cross-sectional view of a hemming roller unit of the present invention (FIG. 5), and a side view of a hemming roller unit of the present invention (FIG. 6). Reference should be made to one of FIGS. 2-6 in the following discussion.

As shown in FIG. 2, a hemming device of the present invention is applied to a wheel house or housing W of a vehicle body in which a reference hole H is preferably formed at a predetermined rear position of the outer surface of an outer panel 1. Such a hole locations is not limiting as the hole can be located at other locations of the outer panel outer surface which otherwise aloe the hemming device of the present device to function in the intended manner.

As shown in FIG. 3, an installation frame 10 is formed by support beams 17 supported by dampers 15 at both sides on an installation plate 13 with casters 11 thereunder and an installation beam 19 disposed at the center on the installation plate 13.

A hemming bed unit 20 supporting the wheel house W, is formed by fixing a hemming bed 21 to the upper end of both support beams 17 on the installation frame 10 and attaching the hemming bed 21 to the outer surface of the outer panel 1 of the wheel house W of a vehicle body.

That is, the hemming bed 21 is formed in an arch or arcuate shape along the wheel house W and is fixed at both ends to the upper ends of the support beam 17 of the installation frame 10.

A reference pin P is fitted into the reference hole H at one side of the wheel house W and is fixed to one end of the hemming bed 21. The restraining pads 23 and 25 that restrain the side panel of the vehicle body in the up-down direction, are provided at the other ends adjacent to the other side of the hemming bed 21.

Also, a latch clamper C, that clamps the other side of the side panel of the vehicle body, is provided at one side of the center portion of the hemming bed 21. In this configuration, the restraining pad 23 provided at the other side of the hemming bed 21 is installed on a restraining bracket 27 fixed to the hemming bed 21. The latch clamper C is disposed on an extender 29 that extends outside from one side of the center of the hemming bed 21.

Further, bed fixing members that fix the hemming bed 21 to the outer panel 1 of the wheel house W are disposed at both sides of the installation beam 19 of the installation frame 10. Both latch clampers C are disposed corresponding to both ends on the hemming bed 21 and on the other end of the fixing beam 31 fixed at one end to both sides of the installation beam 19 of the installation frame 10.

As shown in FIG. 4, the hemming roller unit 40 is mounted to the upper end of the installation beam 19 of the installation frame 10 by a rotary clamper 33 to hem the outer panel with respect to the inner panel of the wheel house by manually rotating two hemming rollers R1 and R2.

The hemming roller unit 40, as shown in FIGS. 4 to 6, includes a lower rotary beam 41, an upper rotary beam 43, and the hemming rollers R1 and R2. The lower rotary beam 41 has a rotational hole 45 at the lower portion so as to be fastened to the installation beam 19 by a rotary shaft bolt 35 with the rotary clamper 33, and a pitch adjusting slot 47 is formed in a rectangular beam shape at one side.

The upper rotary beam 43 is fitted on the lower rotary beam 41 and provided with an adjusting bolt 49 fitted in the pitch adjusting slot 47 of the lower rotary beam 41, and a hinge end 51 is formed at the upper end.

In this arrangement, a spring 53 is inserted in the upper rotary beam 43, with both ends fixed to the inner upper surface of the upper rotary beam 43 and the upper end of the lower rotary beam 41.

In further embodiments, the roller support links 53 and 55 are hinged across each other to the hinge end 51 of the upper rotary beam 43 and the hemming roller R1 and R2 are rotatably disposed at the upper ends of the roller support links 53 and 55.

A gap adjusting bolt 61 adjusting the gap between the hemming rollers R1 and R2 is provided between the roller support links 53 and 55.

In further embodiments, a handle 59, connected to a handle beam 57, is provided at one side of the upper rotary beam 43 to manually rotate the hemming rollers R1 and R2.

Figure 8:
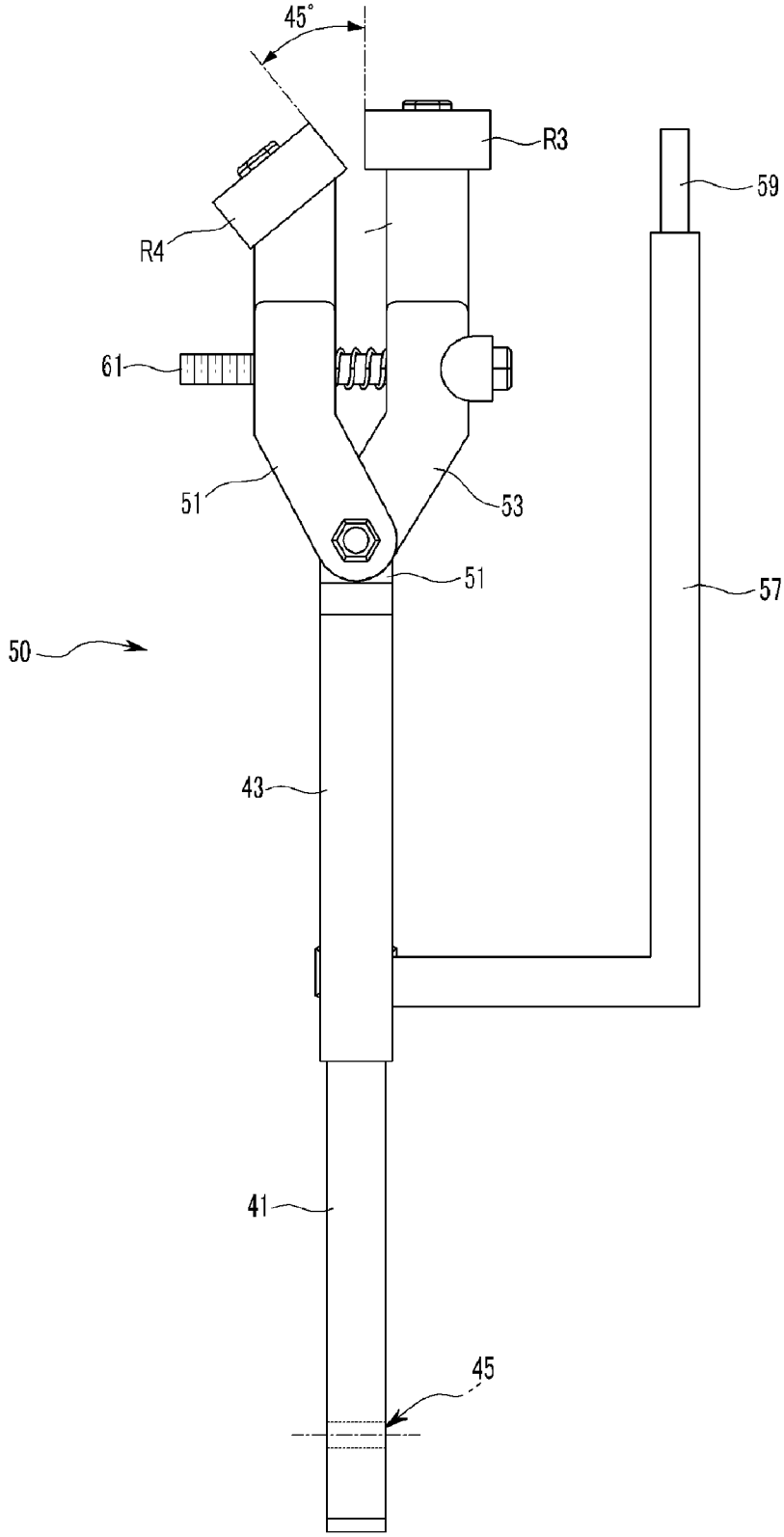
FIG. 8 and FIG. 9 are side views of a hemming roller unit for curl hemming (FIG. 9) and a hemming roller unit for first bending (FIG. 8) for use with a hemming device of the present invention.
Figure 9:
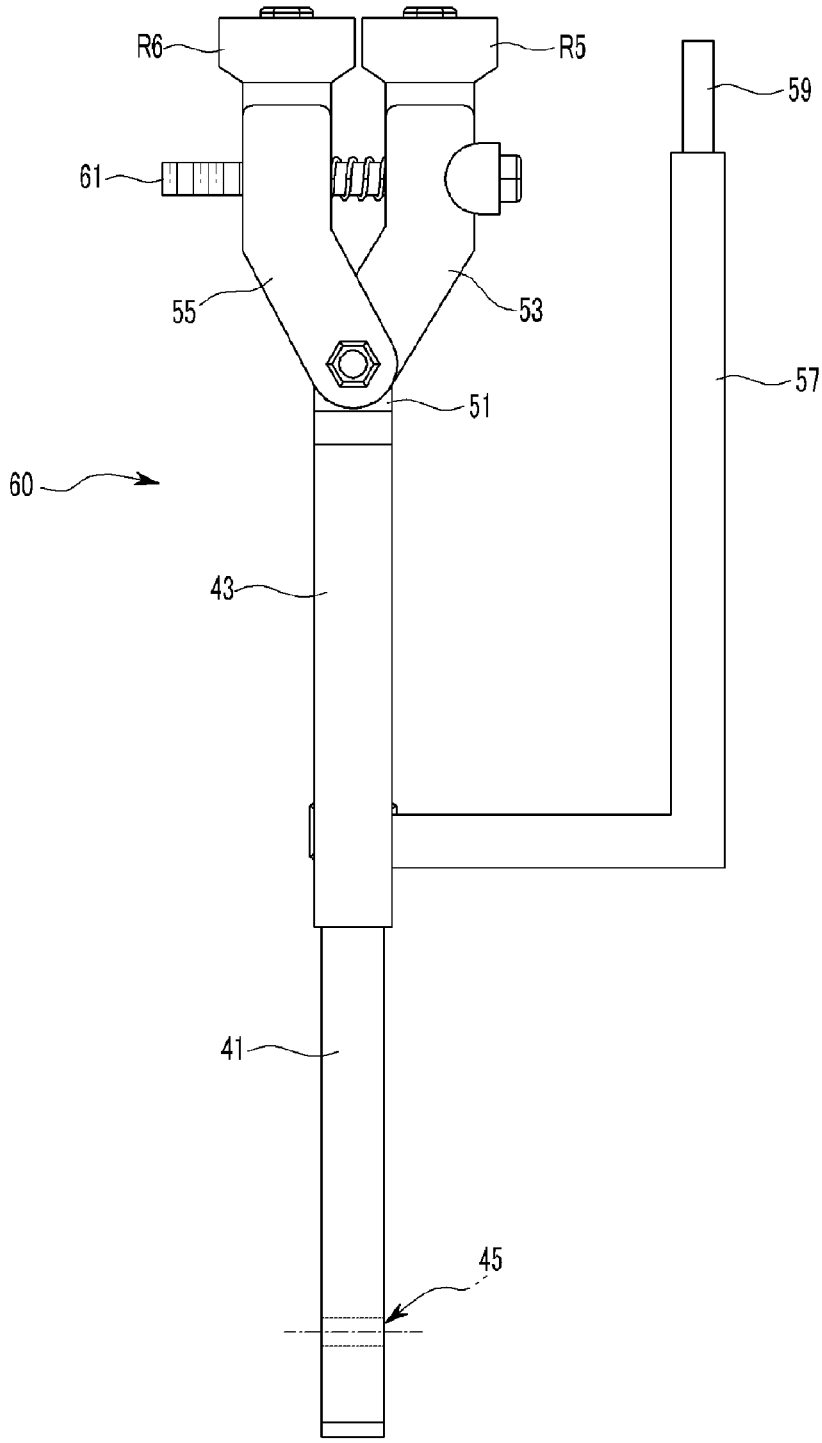

In this arrangement, although the hemming rollers R1 and R2 (see FIG. 6) form the hemming roller unit 40 for second bending that is composed of the hemming rollers R1 and R2 for second bending, which make an angle of 0° between them (see FIG. 8) such rollers can be adapted to form a hemming roller unit 50 for first bending that is composed of hemming rollers R3 and R4 for first bending which make an angle of 45° between them, or as shown in FIG. 9, they are can be arranged to form a hemming roller unit 60 for curl hemming that is composed of curl hemming rollers R5 and R6 making an angle of 0° between them.

Therefore, when using a hemming device according to the present embodiment, the reference position is determined by attaching the hemming bed 21 to the outer surface of the wheel house W of the vehicle body together with the installation frame 10 and then inserting the reference pin P of the hemming bed 21 into the reference hole formed through the outer surface of the wheel house/housing W.

Thereafter, the two restraining pads 23 and 25 are held in an up-down direction to one side of the side panel of the vehicle body. The other side of the side panel of the vehicle body is clamped by the latch clamper C of the hemming bed 21.

As described above, when with the hemming bed 21 is attached to the outer surface of the wheel house/housing W of the vehicle body, both ends of the hemming bed 21 is fixed to both sides of the wheel house W of the vehicle body by both latch clampers C installed at both sides of the installation beam 19 of the installation frame 10 through the fixing beam 31.

After the hemming bed 21 is completely fixed to the outer surface of the wheel house W in the above position, the hemming roller unit 50 for first bending is installed to the rotary clamper 33, as shown in FIG. 8, and first bending is performed to the outer panel 1 with respect to the inner panel of the wheel house W.

Figure 7:
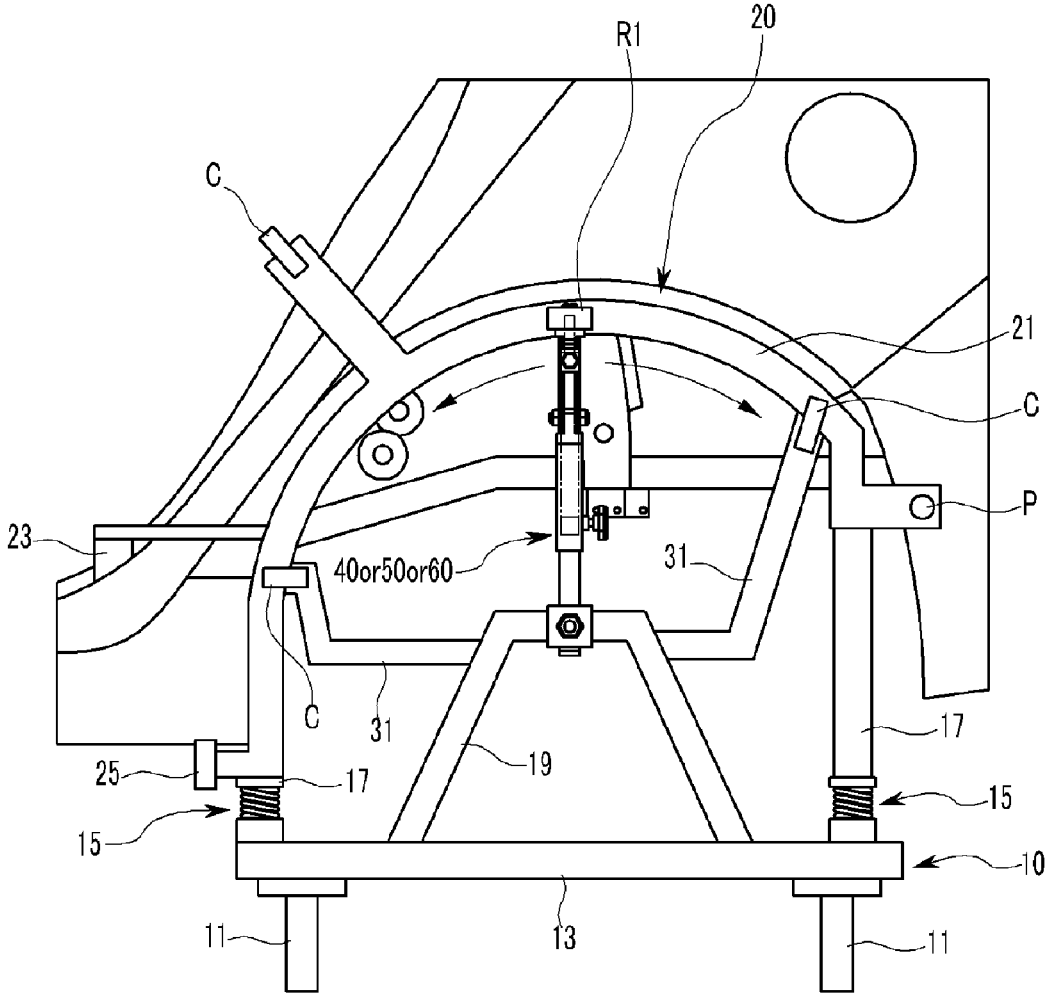
FIG. 7 is a view showing a hemming device according to the present invention when positioned with respect to the wheel housing of the vehicle for use.

In the first bending, as shown in FIG. 7, a worker rotates two to three times the hemming rollers R3 and R4 for first bending having an angle 45° between them, along the hemming bed 21, with a hand holding the rotary handle 59 such that the end of the outer panel is bent to about 45° with respect to the inner panel.

After the first bending is finished, the hemming roller unit 40 for second bending is installed onto the rotary clamper 33, as shown in FIG. 6, and second bending is performed to the outer panel 1 with respect to the inner panel of the wheel house W.

That is, in the second bending, as shown in FIG. 7, a worker rotates two to three times the hemming rollers R1 and R2 for second bending having an angle of 0° between them along the hemming bed 21, with one hand holding the rotary handle 59 such that the end of the outer panel 1 is bent to 0° with respect to the inner panel.

After the first bending is finished, finally, the hemming roller unit 60 for curl hemming is installed onto the rotary clamper 33, as shown in FIG. 9, and curl hemming is performed to the outer panel 1 with respect to the inner panel of the wheel house W.

In the curl hemming, as shown in FIG. 7, a worker rotates two to three times the hemming rollers R5 and R6 for curl hemming having an angle of 0° between them, along the hemming bed 21, with one hand holding the rotary handle 59 such that the end of the outer panel 1 is completely attached to the inner panel.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A hemming device for a wheel house of a vehicle that performs hemming to an outer panel with respect to an inner panel of the wheel house while supporting the outer surface of the outer panel of the wheel house of a vehicle body, the hemming device comprising:

an installation frame formed by support beams supported by dampers at both sides on an installation plate with casters thereunder and an installation beam disposed at the center on the installation plate;

a hemming bed unit fixing the hemming bed to the upper ends of the support beams on the installation frame and supporting the wheel house by attaching the hemming bed to the outer surface of the outer panel of the wheel house of the vehicle body;

bed fixing members disposed at both sides of the installation beam of the installation frame and fixing the hemming bed to the outer panel of the wheel house; and a hemming roller unit mounted to the upper end of the installation beam of the installation frame by a rotary clamper and hemming the outer panel with respect to the inner panel of the wheel house by manually rotating two hemming rollers.

2. The hemming device for a wheel house of a vehicle of claim 1, wherein:

the hemming bed unit comprises:

a hemming bed formed in an arc shape along the wheel house and having both ends fixed to the upper ends of the support beam of the installation frame;

a reference pin provided at one end of the hemming bed and fitted in a reference hole formed at one side of the wheel house;

restraining pads provided at the other end adjacent to the other side of the hemming bed and restraining one side of the side panel of the vehicle body in the up-down direction; and a latch clamper provided at one side of the center of the hemming bed and clamping the other side of the side panel of the vehicle body.

3. The hemming device for a wheel house of a vehicle of claim 1, wherein:

the restraining pad provided at the other side of the hemming bed are installed by a restraining bracket fixed to the hemming bed.

4. The hemming device for a wheel house of a vehicle of claim 1, wherein:

the latch clamper is provided to an extender that extends outside from one side of the center of the hemming bed.

5. The hemming device for a wheel house of a vehicle of claim 1, wherein:

the bed fixing member is a latch clamper that is installed corresponding to both ends on the hemming bed, on the other end of the fixing beam of which one end is fixed to both sides of the installation beam of the installation frame.

6. The hemming device for a wheel house of a vehicle of claim 1, wherein:

the hemming roller unit comprise:

a lower rotary beam having a rotational hole at the lower portion to be fastened to the installation beam by a rotary shaft bolt with the rotary clamper, and a pitch adjusting slot formed at one side;

an upper rotary beam fitted on the lower rotary beam and provided with an adjusting bolt fitted in the pitch adjusting slot of the lower rotary beam and a hinge end formed at the upper end;

a spring inserted in the upper rotary beam, with both ends fixed to the inner upper surface of the upper rotary beam and the upper end of the lower rotary beam;

roller support links hinged to hinge ends of the upper rotary beam;

hemming rollers rotatably installed to the upper ends of the roller support links; and a gap adjusting bolt disposed between the roller support links and adjusting the gap between the hemming rollers.

7. The hemming device for a wheel house of a vehicle of claim 6, wherein:

a rotary handle is provided to a handle beam at one side of the upper rotary beam.

8. The hemming device for a wheel house of a vehicle of claim 6, wherein:

the hemming rollers are hemming rollers for first bending which have an angle of 45° between the rollers.

9. The hemming device for a wheel house of a vehicle of claim 6, wherein:

the hemming rollers are hemming rollers for second bending which have an angle of 0° between the rollers.

10. The hemming device for a wheel house of a vehicle of claim 6, wherein:

the hemming rollers are curl hemming rollers which have an angle of 0° between the rollers.

11. A hemming device for a wheel housing of a vehicle that performs hemming to an outer panel with respect to an inner panel of the wheel house while supporting the outer surface of the outer panel of the wheel house of a vehicle body, the hemming device comprising:

an installation frame;

a hemming bed unit that fixes the hemming bed to an upper portion of the installation frame and supports the wheel housing by attaching the hemming bed to the outer surface of the outer panel of the wheel housing;

bed fixing members disposed at both sides of a segment of the installation frame and fixing the hemming bed to the outer panel of the wheel house; and a hemming roller unit mounted to an upper end of the installation frame upper portion by a rotary clamper and hemming the outer panel with respect to the inner panel of the wheel house by manually rotating two hemming rollers.

12. The hemming device of claim 11, wherein the installation frame is formed by support beams supported by dampers at both sides on an installation plate with casters thereunder and an installation beam disposed at the center on the installation plate.

13. The hemming device of claim 12, wherein the hemming bed unit fixes the hemming bed to the installation frame and supports the wheel housing by attaching the hemming bed to the outer surface of the wheel housing outer panel.

14. The hemming device of claim 11, wherein:

the installation frame includes an installation beam; and the bed fixing members are disposed at both sides of the installation beam fixing the hemming bed to the outer panel of the wheel house.

15. The hemming device of claim 11, wherein:

the installation frame includes an installation beam; and the hemming roller unit is mounted to an upper end of the installation beam by a rotary clamper and hems the outer panel with respect to the inner panel of the wheel house by manually rotating two hemming rollers.

* * * * *